United States Patent [19]

Bustos

[11] 4,415,090

[45] Nov. 15, 1983

[54] AISLE END MERCHANDISING DISPLAY DEVICE

[75] Inventor: Rafael T. Bustos, Atlanta, Ga.

[73] Assignee: Leggett & Platt, Incorporated, Carthage, Mich.

[21] Appl. No.: 266,124

[22] Filed: May 21, 1981

[51] Int. Cl.[3] ..... A47F 7/00

[52] U.S. Cl. ..... 211/49 S; 108/3; 108/60; 211/135; 211/149; 211/150; 211/195; 312/259

[58] Field of Search ..... 211/495, 135, 149, 150, 211/90, 195, 198, 199; 108/3, 35, 60, 61, 51.3, 134, 135, 136, 2; 312/259, 260, 263, 111, 140.2; 5/DIG. 1; 248/174

[56] References Cited

U.S. PATENT DOCUMENTS

| | | | |
|---|---|---|---|
| 944,063 | 12/1909 | Warren | 312/259 X |
| 1,928,508 | 9/1933 | Spang | 108/60 X |
| 2,158,950 | 5/1939 | Swett | 108/35 |
| 2,957,668 | 10/1960 | Norquist et al. | 108/51.3 |
| 3,161,158 | 12/1964 | Lurey | 211/49 S |
| 3,616,938 | 11/1971 | McAleenan | 211/150 |
| 3,677,203 | 7/1972 | Barrineau | 211/49 S |
| 3,729,244 | 4/1973 | Butler | 312/259 X |
| 4,322,005 | 3/1982 | Robertson | 211/150 X |

FOREIGN PATENT DOCUMENTS

| | | | |
|---|---|---|---|
| 364857 | 1/1932 | United Kingdom | 211/49 S |

*Primary Examiner*—J. Franklin Foss
*Assistant Examiner*—David L. Talbott
*Attorney, Agent, or Firm*—Wood, Herron & Evans

[57] ABSTRACT

A corrugated paper merchandising display device for use at the end of a store aisle for displaying large quantities of merchandise. The device comprises three interconnected panels, each of which is in the form of a closed corrugated paper box. The boxes may be opened and overlaid one upon the other for shipment in a flat knock-down condition. When erected, the three boxes form a pair of wing panels and a center panel. Merchandise supporting spring-away shelves are attached to opposite sides of the center panel.

25 Claims, 18 Drawing Figures

AISLE END MERCHANDISING DISPLAY DEVICE

This invention relates to merchandise display devices and more particularly to an aisle end style of display device.

Aisle end display devices are usually placed in retail stores at the end of store aisles for purposes of displaying large volumes of promotional merchandise for relatively short periods of time. Beverage products are often the subject of such displays.

Because aisle end displays are reatively short lived, they are usually temporary in nature. Therefore, they must be fabricated inexpensively from relatively inexpensive materials. Traditionally such displays have been made of corrugated paperboard and have done little more than define the metes and bounds of a display area and provided some form of brand name advertising. In general, such displays have usually consisted of some form of base and a series of boards for separating and stabilizing layers of displayed products. The base in some cases has had upstanding side walls for display of advertising messages but those walls have generally served no other structural purpose.

There has been a long standing need for an aisle end display which has many of the appearance and display characteristics of permanent shelf displays, but has the cost and capacity characteristics of conventional aisle end displays. Particularly, there has been a long standing need for an aisle end display which has the spring-away shelf characteristic of permanent displays in which boards or separators between layers of product are automatically moved aside to expose and display a lower layer of product as an upper layer is removed from the display.

There has also been a need for an end aisle display which is sufficiently flexible to enable different products or products of differing sizes to be displayed on the same display.

The invention of this application satisfies these needs by providing a relatively inexpensive aisle end display which is characterized by spring-away shelves and in which the shelves are so positioned as to enable differing products or products of different sizes to be simultaneously displayed on the same display. According to the practice of this invention, these spring-away shelves are supported from a panel of the display, which panel comprises a corrugated box having a rigid insert contained within the box. The panel is relatively inexpensive to produce and yet has sufficient vertical rigidity to support the spring-away shelves.

In the preferred embodiment of this invention, the shelf supporting panel is the centermost panel of a T-shaped display comprising two wing panels and a center panel. Spring-away shelves are located on both sides of the center panel and a brand name advertising headboard is located above the wing panels. This T-shaped configuration of the center panel and wing panels enables the spring-away shelves to spring into a non-load supporting position without covering up or obscuring the advertising display on the headboard.

The invention of this application also comprises unique spring-away shelves. In one embodiment these shelves comprise multiple ply corrugated paperboard and in another embodiment these shelves comprise multiple ply corrugated plastic. In both embodiments, the ends of torsion springs of the shelves are inserted into end apertures of corrugations of the shelves so as to secure the springs to the shelves. And, in both embodiments, the shelves preferably comprise a second corrugated section attached to the opposite ends of the torsion springs. These second sections preferably have adhesive applied to one side such that the second section of the shelves may be adhered to a vertical wall or panel of a display so as to secure the spring-away shelf to the panel or wall.

The primary advantage of this invention is that it provides an inexpensive display for large volumes of merchandise upon a device which has multiple spring-away shelves. This invention also has the advantage of providing an aisle end display device for simultaneously displaying different products or products of different sizes in a single display. Other advantages of this invention will be more readily apparent from the following description of the drawings in which:

FIG. 13 is a perspective view partially broken away of a shelf.

Figure 1:
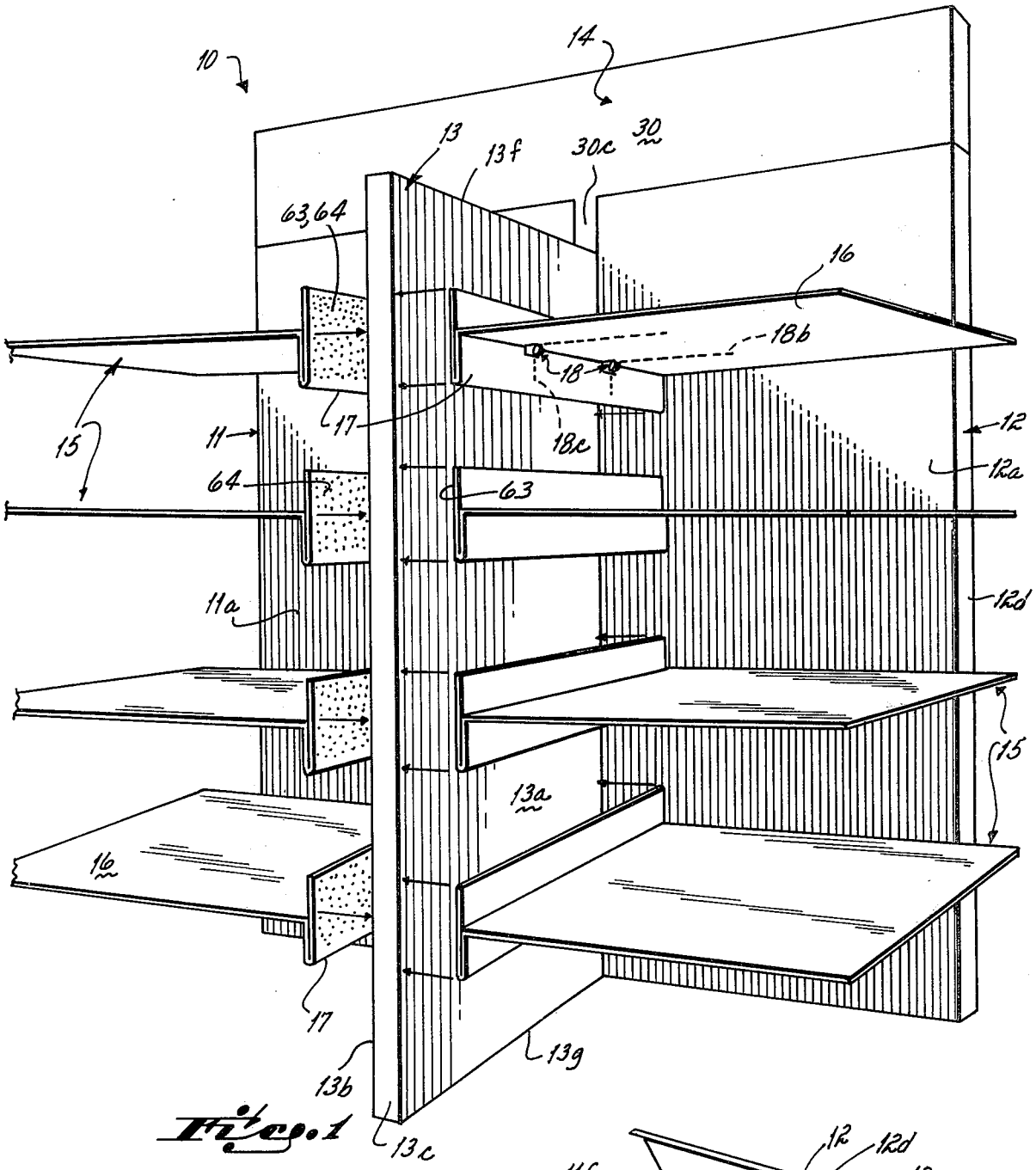
FIG. 1 is an exploded perspective view of a display device incorporating the invention of this application.
Figure 2:
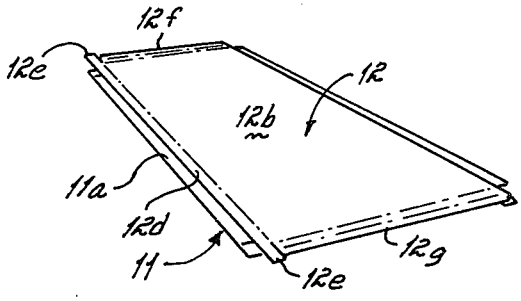
FIGS. 2–8 are perspective views of the display of FIG. 1 illustrating the manner in which the display is assembled after shipment in a knocked-down condition.
Figure 18:
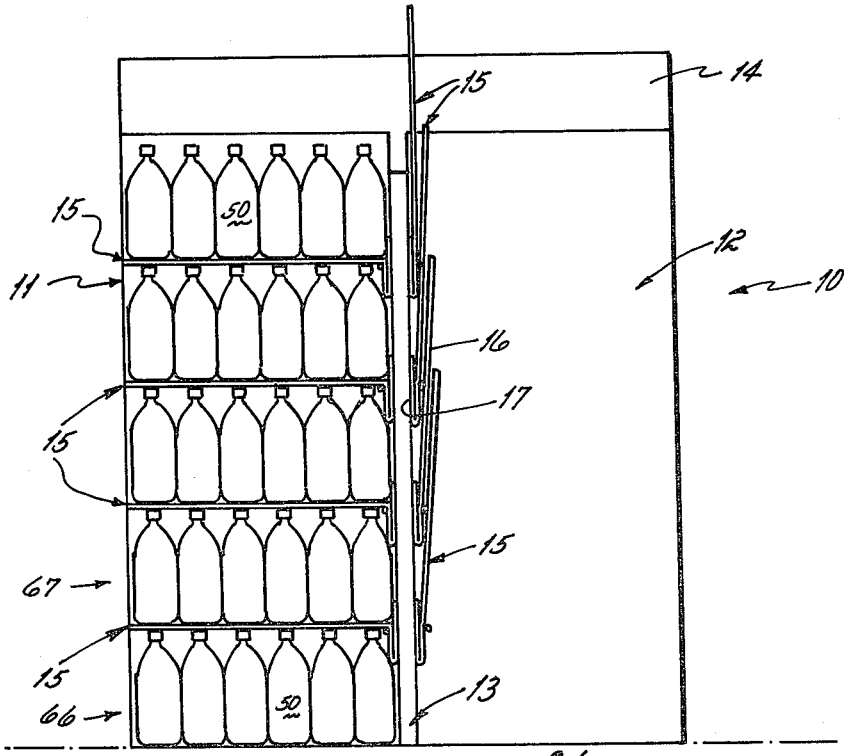
FIG. 18 is a front elevational view of the display of FIG. 1 with product on one side of the display and the other side empty of product.

Referring first to FIG. 1 there is illustrated an aisle end merchandising display device 10 incorporating the invention of this application. This device comprises two wing panels 11 and 12 hingedly interconnected to a center panel 13. The two wing panels are interconnected by a header panel 14. There is a plurality of spring-away shelves 15 attached to the center panel. These shelves each comprise two hingedly interconnected sections, a shelf section 16 and a mounting section 17 interconnected by torsion springs 18 operative to bias the shelves to a raised position in which the shelf section 16 is generally located in a vertical plane as illustrated in FIG. 18.

Figure 4:
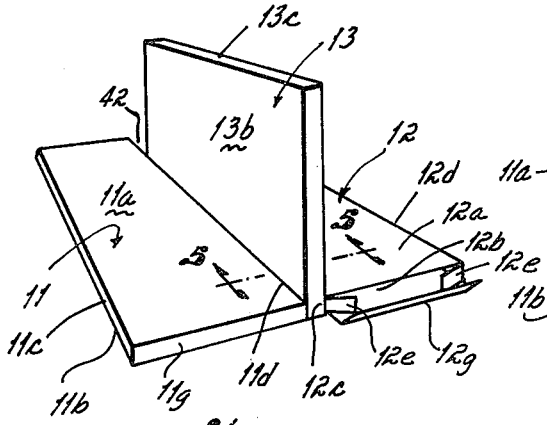
Figure 5:
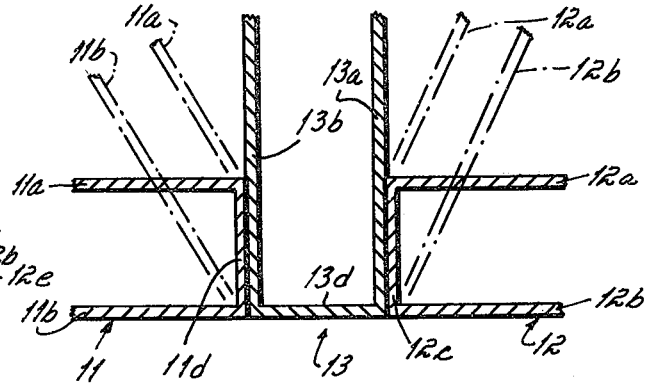
Figure 6:
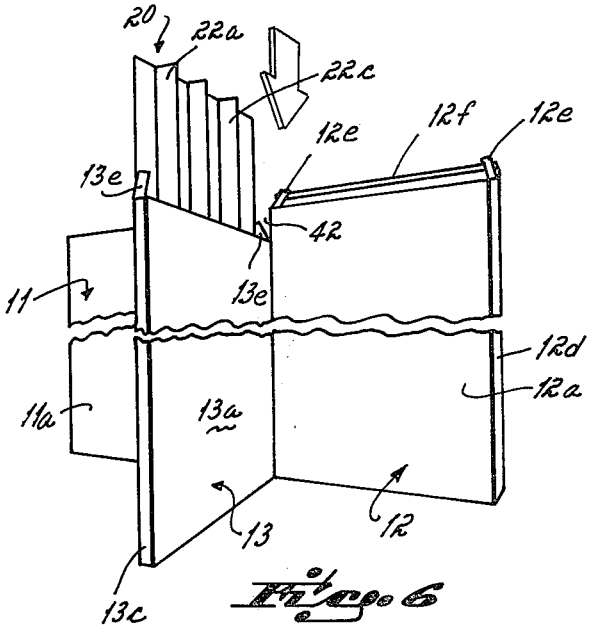

With reference to FIGS. 2–8, it will be seen that each of the wing panels 11 and 12 and center panel 13 comprises a corrugated paperboard box. Each box 11, 12 and 13 has front and rear walls 11*a*, 11*b*, 12*a*, 12*b* and 13*a*, 13*b* and a pair of opposed side walls 11*c*, 11*d*, 12*c*, 12*d*, and 13*c*, 13*d*. End tabs 11*e*, 12*e* and 13*e* extend from and are hingedly connected to both ends of each side wall.l Additionally, there is a tuck flap 11*f*, 11*g*, 12*f*, 12*g* and 13*f*, 13*g* hingedly connected to the top of each rear wall 11*b*, 12*b*, 13*b* and the lower edge of each front wall 11*a*, 12*a*, 13*a*. When the side walls tabs 11*e*, 12*e*, 13*e* of each carton are folded inwardly and the tuck flaps of each panel are inserted into the top and bottom of each panel, the result is three interconnected boxes (FIGS. 4 and 5) having front and rear walls 11*a*, 11*b*, 12*a*, 12*b*, 13*a*, 13*b*, side walls 11*c*, 11*d*, 12*c*, 12*d*, 13*c* and 13*d* and top and bottom walls formed by the tuck flaps 11*f*, 11*g*, 12*f*, 12*g*, 13*f* and 13*g*. The three boxes or panels 11, 12 and 13 are secured together to form a T configuration when erected and viewed in top plan (FIG. 6).

With reference to FIG. 5 it will be seen that the three boxes or panels 11, 12 and 13 are secured together by an adhesive bond between the rear edge of the front and rear walls 13*a*, 13*b* of the center panel 13 and the side walls 11*d*, 12*c* of the wing panels 11 and 12. Thus secured together the three boxes or panels 11, 12, 13 may be collapsed by having the tuck flaps and fold tabs opened. Once collapsed the boxes 11, 12, and 13 may be overlaid one over the other and shipped in a flat knocked down condition (FIG. 2) in which the center panel is overlaid on top of one wing panel and the other wing panel is overlaid on top of the center panel (see phantom lines of FIG. 5).

Figure 3:
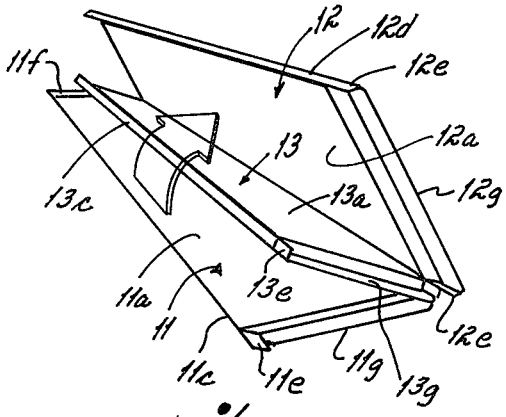

When the three panels in the flat knocked down condition arrive at a store they are easily erected and assembled without the aid of any staples, tools, or connectors. All that is required is for the two wing panels to be folded outwardly into a common plane as illustrated in FIGS. 3 and 4 and the center to be positioned in a plane normal to the two wing panels. With the three panels so positioned the bottom end tabs 11*e*, 12*e*, 13*e* are folded inwardly and the tuck flaps folded into the ends of each panel as illustrated in FIG. 4.

Figure 9:
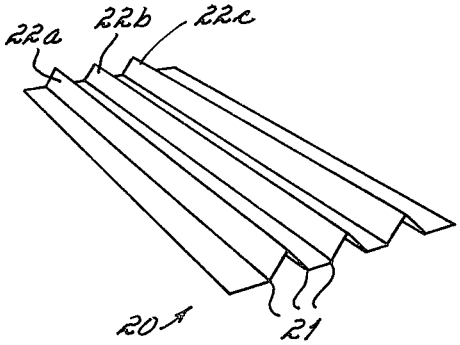
FIG. 9 is a perspective view of a reinforcing insert employed in the display of FIG. 1.

In the preferred embodiment of this invention, the corrugated paperboard box of which the center panel 13 is formed is reinforced by a corrugated paperboard insert 20. With reference to FIG. 9 it will be seen that this insert comprises a flat sheet of multiple ply corrugated paperboard having nine parallel vertical fold lines 21 formed therein. The insert 20 is folded along these fold lines 21 in an accordion style to form three vertical ribs 22*a*, 22*b*, 22*c*. The height of each rib 22*a*, 22*b*, and 22*c* is slightly less than the depth of the center panel and the width of the insert is the same as the inside width of the center panel.

Figure 7:
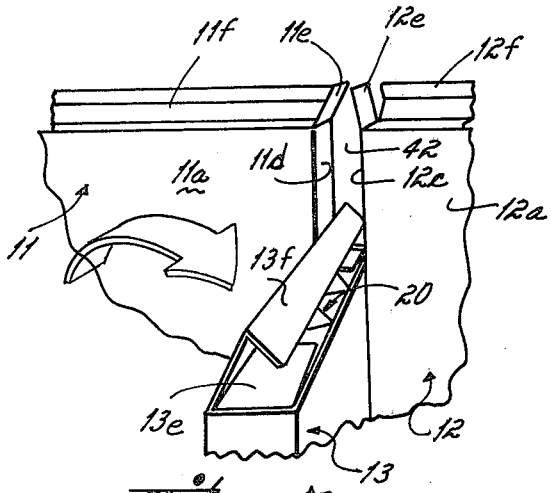
Figure 8:
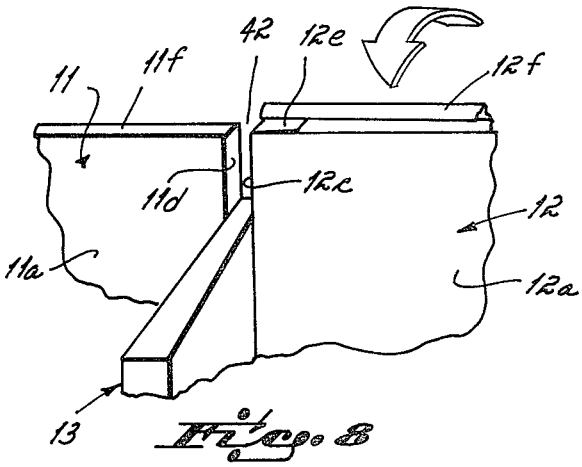

After the wing panels 11, 12 and center panel have been closed at their bottoms as shown in FIG. 4, the "T" shaped display is stood upright as shown in FIGS. 6–8 and the insert 20 is inserted through the open end of the center panel box before the tuck flaps of the box are closed. The manner in which the insert is placed into the box through the open tuck flap is illustrated in FIG. 6. After placement of an insert within the center panel box, the end tabs and tuck flaps of all three panels are closed.

The wing panels 11 and 12 are preferably maintained in a colinear relationship by means of the head 14 mounted on top of the two wing panels 11 and 12. This header 14 is also preferably manufactured from conventional three ply corrugated paper.

Figure 10:
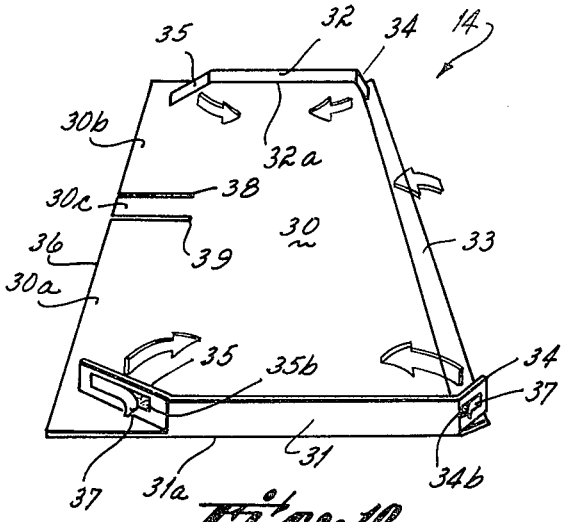
FIG. 10 is a perspective view of the header employed in the display of FIG. 1, and illustrating the manner in which this header is assembled.

As seen in FIG. 10, the header panel 14 comprises a center rectangular section 30 having side flaps 31, 32 attached thereto by fold lines 31*a* and 32*a*. Additionally, there is a top flap 33 attached to the center section 30 by a fold line 33*a*. Each side flap 31, 32 has top and bottom tabs 34, 35 connected thereto by fold lines 34*a*, 35*a* respectively. Each tab 34, 35 has a strip of adhesive 34*b*, 35*b* thereon covered by a sheet of protective paper 37. At the bottom of the rectangular section 30 of the header there are two slots 38, 39 which extend inwardly from the bottom edge 36. These slots 38, 39 are equidistantly spaced from the center of the bottom edge of the panel and are spaced apart a distance equal to the thickness or depth of the center panel 13.

Figure 11:
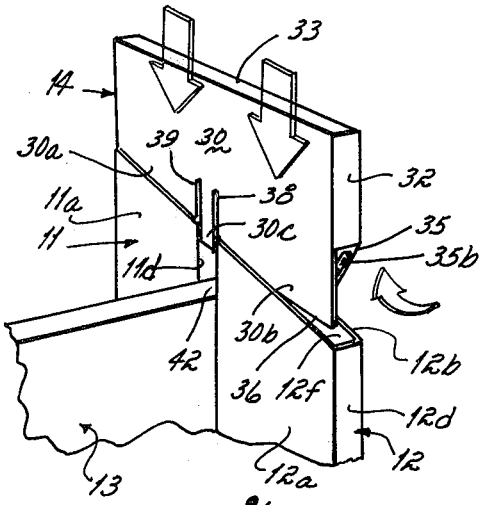
FIG. 11 is a perspective view illustrating the manner in which the header of FIG. 10 is attached to the display.

To assemble the header section 14, the side flaps 31, 32 are folded upwardly and their top end tabs 34 are folded inwardly as illustrated in FIG. 10. The protective paper 37 over the strips of adhesive 34*b* on the end tabs 34, 35 are removed and the top flap 33 folded inwardly into contact with the inwardly folded tabs 34. The adhesive 34*b* on the tabs then adheres the tabs to the top flap 33. The bottom tabs 35 are then folded inwardly and the protective paper 37 over the strips of adhesive 35*b* on these tabs is removed. As shown in FIG. 11, the assembled header 14 is then mounted on the wing panels by insertion of the bottom sections 30*a*, 30*b* of the rectangular panel 30 into slots defined between the tuck flaps 11*f*, 12*f* of the wing panels and the front walls 11*a*, 12*a* of those panels. The bottom sections 30*a*, 30*b* of the header are inserted into the slots until the exposed adhesive strip 35*b* on the bottom of the tabs 35 contact the top surface of the tuck flaps and adhere the flaps 35 to the top surface of the assembled wing panels. When thus assembled, the strip 30*a* between the two slots 38, 39 fills a gap 42 between the two wing panels 11, 12 and the top of the center panel 13.

Figure 12:
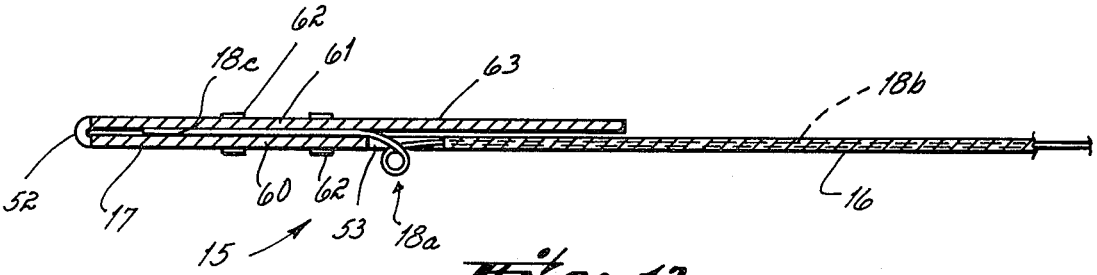
FIG. 12 is a cross sectional view through a shelf embodying the display of FIG. 1.

Referring to FIGS. 12 and 13 there is illustrated in detail the spring-away shelves employed in the display of this invention. When not loaded with product 50, each of these shelves is maintained in a vertical attitude as illustrated in FIG. 18, but each shelf may be moved downwardly into a generally horizontal plane against the bias of springs 18 contained in each shelf and will be maintained in the horizontal plane so long as there is product supported upon the shelf. With reference to FIGS. 11 and 12 it will be seen that each shelf comprises the shelf section 16 and the mounting section 17. In the preferred embodiment both sections are made integral from a single continuous piece of shelving material. In one embodiment of this invention this shelving material comprises conventional three ply corrugated paper while in a second embodiment the shelf is made from three ply corrugated plastic. In both the paper and plastic embodiments, the shelf is manufactured from a single continuous rectangular strip of corrugated material. The shelf section 16 of the material is connected to the mounting section 17 by a transverse score line 51. The mounting section 17 of the shelf in turn comprises two overlapped sections of the corrugated material interconnected by a bottom fold line 52.

At the point at which the shelf section 16 joins the mounting section 17, the edges of the shelf are notched or cut out as indicated at 53 for reception of the torsion springs 18. These torsion springs 18 comprise a tightly wound helical section 18*a* and a pair of straight end sections 18*b* and 18*c*. In the relaxed condition of these springs 18, the end sections 18*b*, 18*c* are generally located in a common plane and extend in a common direction. This relaxed condition of the spring 18 is illustrated in FIG. 12. One end 18*b* of the spring is mounted in the shelf section 16 of the shelf 15 by insertion of the end section 18*b* into an aperture defined by the corrugations of the shelf 15.

With reference to FIG. 13 it will be seen that the shelf is made from a wave or sinusoidal shaped center ply 55 of paper or plastic sandwiched between two flat plies 56, 57 of paper or plastic. In the case of the paper modification, the two flat plies are adhered to the wave shaped ply 55. In the case of the plastic modification, the plies are integrally joined by being placed in overlaid contact immediately after the plies are extruded and while the three plies are still in a semi-molten state. When the three plastic plies subsequently harden, they fuse to form a unitary three ply corrugated plastic sheet.

The end 18*b* of the spring 18 is received within one end aperture and extends parallel to the corrugations of the sheet material of which the shelf is made. The opposite end 18*c* of the torsion spring 18 is sandwiched between the two overlapped sections or plies 60, 61 of the mounting section 17 of the shelf. This opposite end 18*c* of the spring 18 may be secured between the two plies 60, 61 by staples 62 which extend between and secure the two plies 60, 61 of the mounting portion of the shelf together or may be adhered between the two plies by any conventional adhesive.

The torsion springs 18 extend between the mounting section and the shelf section of the shelf 17 to enable the shelf section 16 to be bent downwardly from the position in which the two sections are generally colinear as illustrated in FIG. 12 to a position in which the shelf section extends at a 90° angle to the mounting section. This latter position requires that the tension of the spring 18 be overcome in order to move the shelf section down out of the plane of the mounting section into a plane normal to that section.

The rear surface 63 of the mounting section 17 of the shelf is covered with a layer of adhesive 64 (FIG. 1) over which there is a sheet of protective paper (not shown). When this protective paper is removed, the adhesive 64 over the back surface 63 of the mounting section of the shelf may be adhered to either the front or rear surfaces 13*a*, 13*b* of the center panel of the display.

Figure 15:
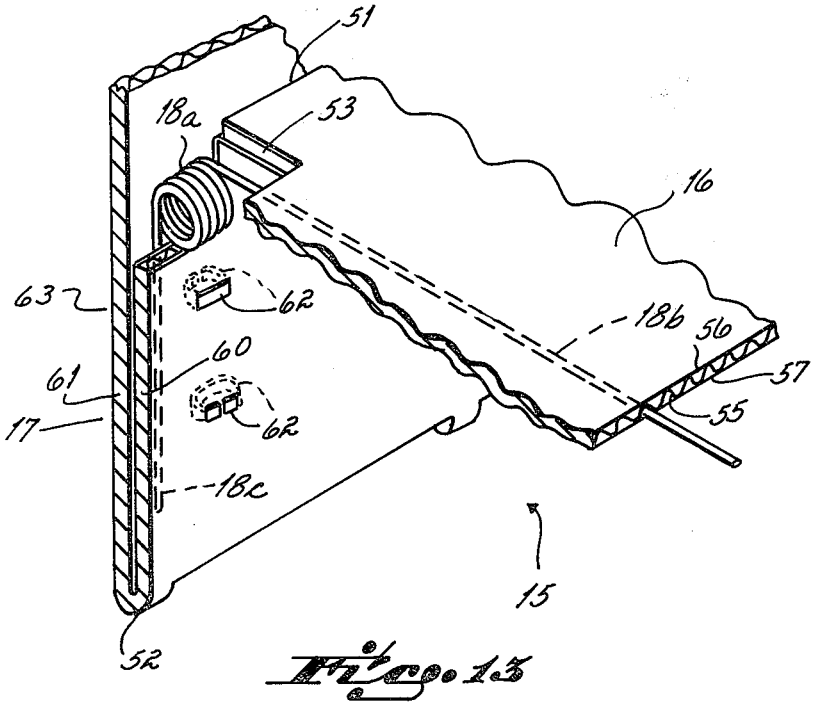
FIGS. 14–17 are partially diagrammatic front elevational views illustrating the manner in which shelves are attached to the center panel of the display of FIG. 1.
Figure 14:
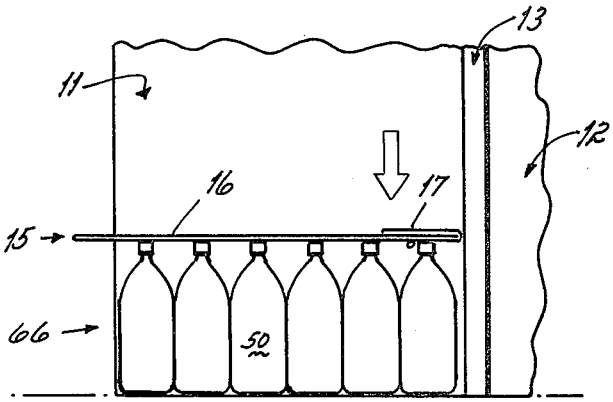
Figure 15:
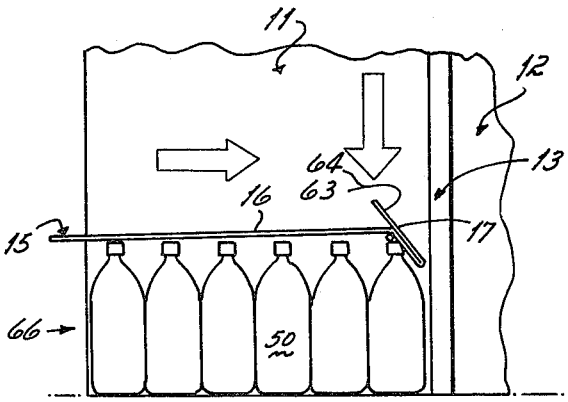
Figure 16:
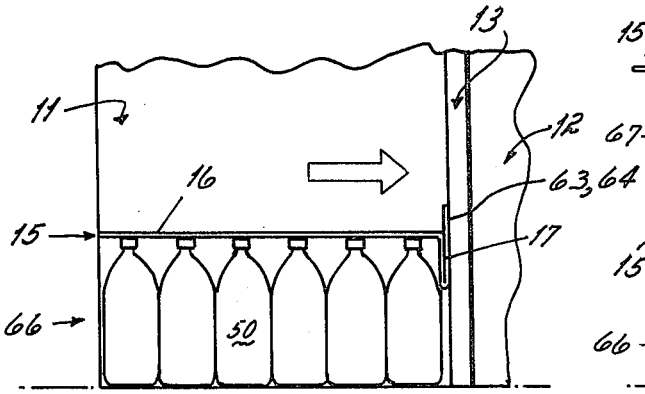
Figure 17:
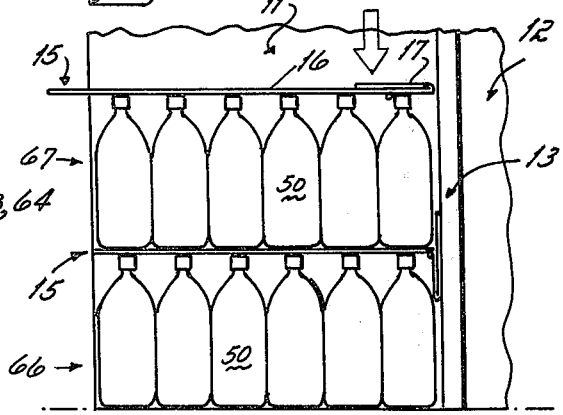

With reference to FIGS. 14–17 it will be seen that in order to mount a shelf on the center panel 13 of the display, a layer of product 50 such as a layer 66 of bottles is first placed on the floor or base upon which the display 10 is located. A shelf 17 is then placed over the top of the bottom layer 66 of bottles or product 50 with the mounting section 17 of the shelf overlying the shelf section 16 as illustrated in FIG. 14. The shelf is then pushed inwardly against the center section of the panel as illustrated in FIG. 15 so as to cam the mounting section 17 of the shelf into a vertical plane from the horizontal plane. In the course of being cammed from the horizontal to the vertical plane, as illustrated in FIGS. 14–16, the tension of the torsion spring 48 must be overcome. When the shelf is finally pushed all the way inwardly toward the center panel the mounting section 17 of the shelf rests flat against the front or rear face of the center panel 13. In this position the rear surface 63 of the mounting section of the panel to which adhesive 64 is applied is attached to the front or rear face 13*a*, 13*b* of the center panel. After attachment of the lowest shelf, a second layer 67 of product 50 is placed on the shelf and the shelf next above is applied by the shelf mounting procedure of FIGS. 14–16. This procedure is repeated until all the shelves are located on both sides of the center panel 13 and the display is fully loaded with layers of product 50.

Once the shelves have been attached to the display 10 they are permanently adhered to the center panel 13. Thereafter, as product is removed from the upwardmost shelf, that empty shelf springs upwardly into a generally vertical plane as illustrated in the right side of FIG. 18. When the display is to be reloaded with product, a layer of product is placed on the floor and the lowermost unloaded shelf is pulled downwardly, and a layer of product is then placed thereon. Thereafter, the next shelf above the now loaded lowermost shelf is pulled down and the process repeated.

The advantage of the display heretofore described is that it provides an inexpensive, temporary type of aisle end display in which there are multiple spring-away shelves for supporting large quantities of product. When the shelves spring away into the unloaded condition they do not cover or obscure the brand name identified on the headboard 14. The display is equally attractive with the shelves either in the lowered or a raised condition.

While I have described only a single preferred embodiment of my invention, persons skilled in this art will readily recognize numerous changes and modifications which may be made without departing from the spirit of my invention. Therefore, I do not intend to be limited except by the scope of the following appended claims:

I claim:

1. A merchandise display device for displaying stacks of containers on the end of a store aisle, said display device comprising, a pair of colinearly aligned wing panels located in a generally vertical plane, a center panel, said center panel having one vertical edge located between and in juxtaposition to said wing panels, said center panel being located in a vertical plane which is perpendicular to said wing panels, and a plurality of shelves secured to opposite sides of said center panel, each of said shelves including spring means interconnecting said shelf to said center panel and operable to bias said shelves into a position in which each shelf is located in a generally vertically extending attitude parallel to said center panel but is movable against the bias of said spring means into a generally horizontal load supporting plane.

2. The merchandise display device of claim 1 in which each of said wing and center panels comprises a closed corrugated paperboard box, and a folded paperboard insert located within said center panel, said insert having fold lines which extend in a vertical direction.

3. The merchandise display device of claim 1 in which said spring means comprises a torsion spring having one end fixed relative to said center panel and an opposite end attached to a shelf.

4. The merchandise display device of claim 3 in which each of said shelves comprises a sheet of multiple ply corrugated material, said opposite ends of each of said torsion springs being secured to said shelf by location of said opposite ends in apertures in the edges of said shelves defined by the corrugations of said corrugated material.

5. The merchandise display device of claim 1 in which each of said shelves comprises a unitary sheet of material, each of said shelves having a first section adapted to be secured to said center panel and a second section attached to said first section by a fold line in said sheet of material.

6. The merchandise display device of claim 5 in which said first section of each of said shelves is adapted to be adhered to said center panel.

7. The merchandise display device of claim 1 in which each of said wing and center panels is hingedly connected to the other panels along vertical fold lines such that said panels may be folded about said fold lines and overlaid one upon the other for shipment in a flat condition.

8. The merchandise display device of claim 7 in which each of said wing and center panels comprises a closed corrugated paperboard box.

9. The merchandise display device of claim 8 in which the ends of each of said boxes may be opened and said boxes flattened for shipment in a flat condition.

10. A merchandise display device for displaying stacks of containers, said display device comprising, a first panel located in a generally vertical plane, a second panel, said second panel having one vertical edge located in juxtaposition to said first panel, said second panel being located in a vertical plane which is perpendicular to said first panel, said second panel comprising a closed corrugated paperboard box, rigidifying means contained within said box for increasing the vertical rigidity of said box, and a plurality of shelves secured to said second panel, each of said shelves including spring means interconnecting said shelf to said second panel and operable to bias said shelves into a position in which each shelf is located in a generally vertically extending attitude parallel relative to said second panel but is movable against the bias of said spring means into a generally horizontal load supporting plane.

11. The merchandise display device of claim 10 in which said reinforcing means comprises a folded paperboard insert having fold lines which extend in a vertical direction.

12. The merchandise display device of claim 10 in which said first panel comprises a closed corrugated paperboard box.

13. The merchandise display device of claim 12 in which each of said closed corrugated paperboard boxes comprises four side walls, an end wall attached to one of said side walls, a pair of tabs attached to two opposed side walls, and a flap attached to said end wall, said flap being folded into said box to maintain said box in an erect condition.

14. The merchandise display device of claim 13 in which the ends of each of said boxes may be opened and said boxes flattened for shipment in a flat condition.

15. The merchandise display device of claim 14 in which each of said boxes is hingedly connected to the other box along vertical fold lines such that said boxes may be folded about said fold lines and overlaid one upon the other for shipment in a flat condition.

16. The merchandise display device of claim 10 wherein each of said shelves comprises first and second sections, both of said sections comprising a sheet of multiple ply corrugated material, said sheet having one ply of material configured into a sinusoidal wave shaped configuration and a second flat ply of the same material secured to said sinusoidal wave shaped ply.

said first section having an exposed edge normal to the corrugations of said section, and said spring means comprising a torsion spring having two ends, one of said ends extending into an aperture in the exposed edge of said first shelf section defined between the corrugated and flat plies of said first shelf section, and the other end of said torsion spring being secured to said second shelf section.

17. The shelf of claim 16 in which each of said plies of said first and second sections of said shelf is made from paper.

18. The shelf of claim 16 in which each of said plies of said first and second sections of said shelf is made from plastic.

19. A shelf for use on a merchandise display device, said shelf comprising first and second sections, said first and second sections comprising a single unitary sheet of multiple ply corrugated material separated by a score line between the two sections, said sheet having one ply of material configured into a sinusoidal wave shaped configuration and a second flat ply of the same material secured to said sinusoidal wave shaped ply, said score line being normal to the corrugations of said first section and spring means interconnecting said first and second sections, said spring means comprising a pair of torsion springs, each of said torsion springs having two ends, one of said ends of each of said springs extending into an aperture in the exposed edge of one of said shelf sections defined between the corrugated and flat plies of said one shelf section, and the other end of each of said torsion springs being secured to said other shelf section.

20. The shelf of claim 19 in which each of said plies of said first sections of said shelf is made from paper.

21. The shelf of claim 19 in which each of said plies of said first sections of said shelf is made from plastic.

22. The shelf of claim 19 in which one of said sections has a flat surface adapted to be secured to a planar shelf supporting surface, and a laminate of adhesive applied to said flat surface of said one section.

23. The shelf of claim 22 in which said laminate of adhesive is adapted to be covered by a removable covering sheet so as to enable said flat surface to be adhered to a planar shelf supporting surface after removal of said covering sheet.

24. The shelf of claim 19 in which said other shelf section comprises two overlapped layers of said sheet of corrugated material.

25. The shelf of claim 24 in which the other end of each of said torsion springs is secured between said overlapped layers of said sheet of corrugated material.

* * * * *